US005203515A

United States Patent [19]

Stoerzbach

[11] Patent Number: 5,203,515

[45] Date of Patent: Apr. 20, 1993

[54] APPARATUS FOR THE CONTINUOUS KINEMATIC HIGH FREQUENCY TREATMENT OF A SUBSTANCE AND METHOD FOR THE MANUFACTURE OF SAID DEVICE

[75] Inventor: Wolfram Stoerzbach, Luzern, Switzerland

[73] Assignee: Kinematica AG, Littau, Switzerland

[21] Appl. No.: 635,223

[22] Filed: Dec. 28, 1990

[30] Foreign Application Priority Data

Jan. 5, 1990 [EP] European Pat. Off. ..... 90810012.6

[51] Int. Cl.[5] ..... B02C 19/00

[52] U.S. Cl. ..... 241/89.3; 241/95

[58] Field of Search ..... 310/160, 161, 266; 210/174; 241/87, 87.1, 89.3, 95

[56] References Cited

U.S. PATENT DOCUMENTS

| | | | |
|---|---|---|---|
| 3,722,805 | 3/1973 | Storm | 241/89.3 |
| 4,015,783 | 4/1977 | Miller | 241/89.3 |
| 4,555,064 | 11/1985 | Asano | 241/89.3 |
| 4,860,960 | 8/1989 | Schwarz | 241/89.3 |

FOREIGN PATENT DOCUMENTS

| | | | |
|---|---|---|---|
| 0944281 | 6/1956 | Fed. Rep. of Germany | 241/87 |
| 0926587 | 10/1947 | France | 241/87 |
| 604894 | 12/1977 | Switzerland . | |
| 220000 | 12/1924 | United Kingdom . | |
| 806085 | 12/1958 | United Kingdom . | |
| 2075352 | 11/1981 | United Kingdom . | |
| 2151978 | 7/1985 | United Kingdom . | |

*Primary Examiner*—R. Skudy
*Attorney, Agent, or Firm*—Marks & Murase

[57] ABSTRACT

The apparatus for continuous kinematic high frequency treatment of a substance or a mixture of substances is provided with two respective comminution member rings both on the stator and on the rotor. At least the outermost comminution member ring and generally the three outermost comminution member rings are provided with narrow slots having a width of less than 1 mm, preferably less than 0.5 mm, which are closed at the free end of said rings. The closed slots are manufactured by means of a carbon dioxide laser device. In the process, first the comminution members, which are provided with holding means, are manufactured and the slots are cut by the laser device, and then the two holding means of the stator and the two holding means of the rotor are welded together. By providing these narrow slots, a finer mixture with higher efficiency is obtained.

15 Claims, 1 Drawing Sheet

FIG. 1
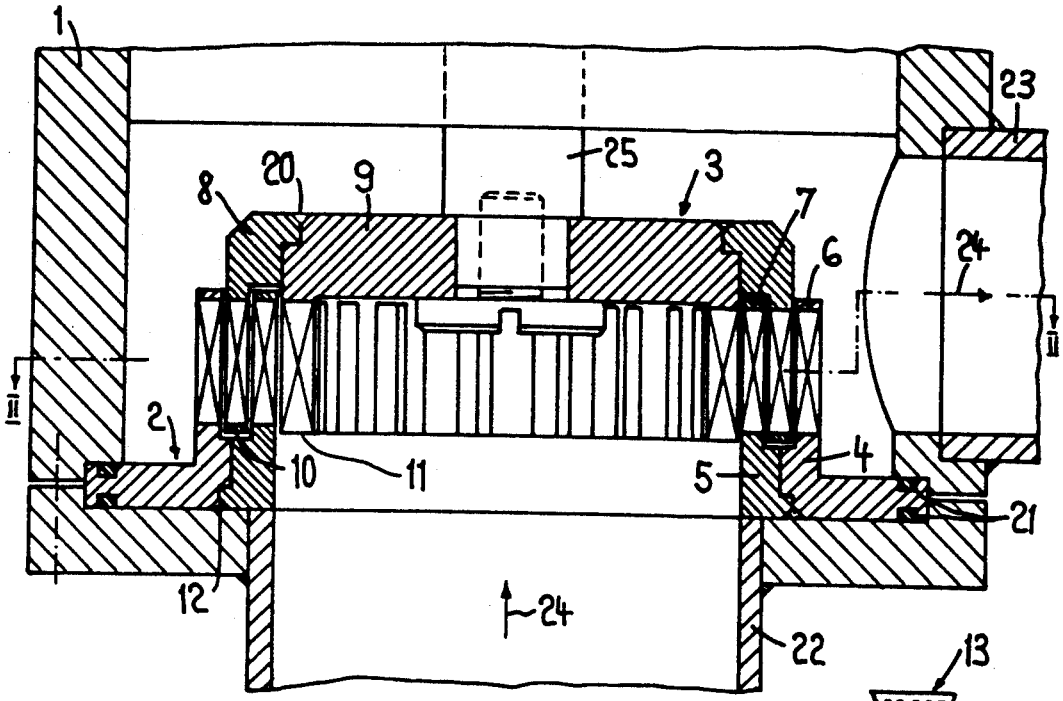
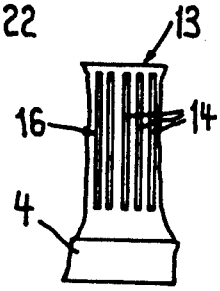
FIG. 3
FIG. 2
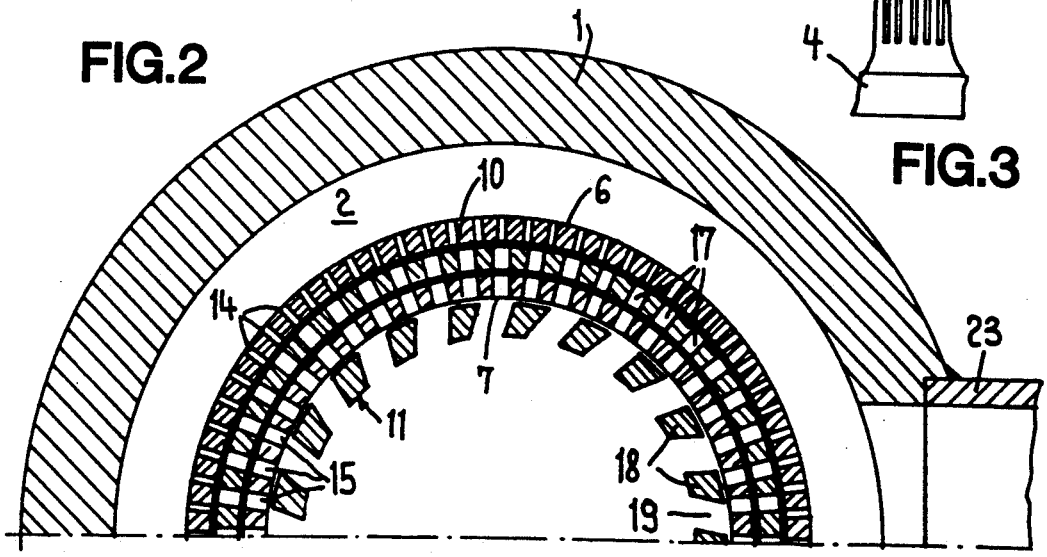

APPARATUS FOR THE CONTINUOUS KINEMATIC HIGH FREQUENCY TREATMENT OF A SUBSTANCE AND METHOD FOR THE MANUFACTURE OF SAID DEVICE

The present invention refers to an apparatus for the continuous kinematic high frequency treatment of a substance or a mixture of substances in the form of a cylindrical arrangement of at least two mutually counterrotatable comminuting member rings which enclose each other and are fitted on holders, and to a method for the manufacture of such an apparatus. Such an apparatus is known e.g. from CH-A-604 894 and is based upon a method and an apparatus for the continuous kinematic high frequency treatment of a substance or a mixture of substances as developed by Prof. Willems and described in numerous patent specifications. On the base of these patents, a number of laboratory apparatus have been developed which are marketed by the applicant. These apparatus are formed of a stator and a rotor rotating therein, the stator generally comprising slots and the rotor consisting of two blades which are provided with a cutting edge, in some cases, or possibly of a comminuting member ring. The slots are milled, this finishing method resulting in relatively wide slots, however. Yet, for the production of certain emulsions or suspensions, the width of the slots is preferably as small as possible, but the manufacture of such narrow slots by means of conventional mechanical means is either very difficult to accomplish and expensive, or it is impossible, and moreover, there is a great risk that individual teeth break off as a result of vibrations, whereby the entire apparatus may be destroyed. Although the tendency to vibrate might be reduced by using rounded milling cutters, only relatively wide slots of substantially more than 1 mm could be milled due to their wedge effect.

On this background, it is the object of the present invention to provide an apparatus and a method for its manufacture which under the above-mentioned conditions yield a higher efficiency and a better mixing capacity. This object is attained by means of an apparatus wherein at least one of the comminution member rings of each holder is provided with slots which are closed at the free end of said rings, and wherein said slots of at least one of said comminution member rings have a width of less than 1 mm and preferably less than 0.5 mm, and by a method wherein said closed slots are manufactured by means of a carbon dioxide or a solid state laser device, the working beam being adjusted in such a manner that said slots are shaped approximately rectangularly. Hereinafter, the invention is explained in more detail with reference to a drawing of an embodiment.

DESCRIPTION OF THE DRAWING

FIG. 1 shows a longitudinal section of an embodiment of the invention;

FIG. 2 shows a section according to line II/II in FIG. 1; and

FIG. 3 shows a detail of a side view.

DESCRIPTION OF THE PREFERRED EMBODIMENT

FIG. 1 shows the lower portion of an apparatus for homogenizing, dispersing, suspending, comminuting, fraying, gassing or the like. FIGS. 1 and 2 show the stator 2 which is attached to housing 1 and the rotor 3 which is rotating therein and is shown on top thereof in FIG. 1. Stator 2 is provided with a bipartite holder 4, 5, consisting of two holder pieces 4 and 5 on which the comminuting member rings 6,7 are arranged. Said rotor 3 is also provided with a bipartite holder 8,9, consisting of two holder pieces 8 and 9 which the comminuting member rings 10,11 are secure The separate manufacture and finish of the holder pieces with the comminuting member rings is particularly advantageous if the comminuting member rings have different numbers and sizes of teeth and slots, respectively.

When processing certain compositions, e.g. emulsions, it is desirable to keep the flow rate through the comminution members approximately constant. Since the comminution member rings are disposed in a concentrical arrangement with increasing radiuses, as appears especially in FIG. 2, the slot width must necessarily decrease from the center to the outside, which makes a separate working of the individual comminution member rings advantageous.

As already mentioned in the introduction, it is advantageous to have as narrow slots as possible, especially as far as the outermost comminution member ring 6 is concerned. Basically, it would be possible to manufacture narrow slots by means of very fine sawing blades or the like. In order to avoid very high manufacturing costs, these slots would have to be open on the side of the free end, i.e. at the top in FIG. 3. However, considering the high rotation speeds and flow rates, this results in vibrations which lead to the destruction of individual teeth and to a risk for the entire apparatus to be destroyed. For the manufacture of such narrow slots, the use of a carbon dioxide laser device is particularly advantageous, whereby it is possible to obtain slots 14 which are closed at the free end 13 and which have a width of less than 1 mm, e.g. 0.5 mm. Depending on the size of the slots in the outermost comminuting member ring 6, the slots 15 of the inner comminuting member 7 of the stator will also be manufactured by means of said laser device, these slots being closed at the free end as well. After the manufacture of the slots, the two holders are welded together. Further, the manufacture of such slots by means of a carbon dioxide laser is also advantageous in that the edges, respectively the narrow sides 16 of the slots have a rectangular profile, whereby a perfect flow is guaranteed.

Analogically, the bipartite holder 8,9 of the rotor 3 is also composed of two holder pieces which the comminution member rings 10,11 are arranged. Depending on the desired width, the slots 17 of the outermost comminuting member ring 10 have to be manufactured by means of a laser as well, these slots also being closed free end. The innermost ring 11 of the comminutation member rings and thus of the apparatus serves for coarse preliminary comminution, on one hand, and on the other hand, it provides a pumping effect. Therefore, this innermost ring is provided with coarse teeth 18 which are open at the free end, the gaps 19 therebetween deviating from the radial direction. These teeth are manufactured with known methods. After manufacture of the slots, respectively the teeth of the comminution member rings, the latter, i.e. their holder pieces 8,9 are welded together as schematically illustrated by the welding seam 20.

According to known methods, the bipartite holder 4,5 of the stator 2 is secured via tight joints 21 to the lower housing portion 1 to which an inlet pipe 22 and an outlet pipe 23 are connected. The direction of flow of the substance or mixture thereof is indicated by arrows 24.

The bipartite holder 8,9 of the rotor 3 is connected to rotor shaft 25 also techniques. The remaining parts as well as the drive means are state of the art. In particular, the rotor and the stator are such dimensions as to be compatible with apparatus which are known and already introduced in the market.

As has been indicated in the description, it is advantageous for emulsions that the flow rate through the comminution member rings is approximately constant, but this does not apply for all compositions. For example, it may be preferable for the manufacture of paint to have outwardly increasing slot widths, whereby the flow rate decreases towards the outside. Yet, in this case, the manufacture of narrow slots by means of a laser provides great advantages too, said laser not necessarily being a carbon dioxide laser. Under certain conditions, a continuously operating solid state laser may be used as well.

Moreover, the invention is not confined to the described embodiment. There might be several rotor crowns running inside more than two stator crowns having graduated diameters, or only one rotor crown in one stator crown. Although the stator, as its name indicates, is generally stationary, it may be rotatable in special devices, and it would be counterrotating with respect to the rotor. Such devices may have the shape of continuous processors or of immersion rods.

What I claim is:

1. An apparatus for the continuous kinematic high frequency treatment of a substance having cylindrically arranged at least two comminuting member rings rotatable relative to each other which enclose each other and are fitted on holders, wherein at least one of said comminuting member rings of each holder is provided with slots which are closed at both ends of said rings, and wherein said slots of at least one of said communicating member rings have a width of less than 1 mm.

2. A device according to claim 1, wherein one of said holders is shaped as a stator and the other is shaped as a rotor, each of which is provided with two comminuting member rings, said rotor running inside said stator, and wherein said slots closed at both ends are disposed on the outermost comminuting member ring of said stator.

3. A device according to claim 1, wherein said substance is a mixture of substances.

4. A device according to claim 1, wherein said slots have a width of less than 0.5 mm.

5. An apparatus according to claim 1, wherein said slots are formed by a carbon dioxide laser.

6. An apparatus according to claim 1, wherein said slots are formed by a solid state laser.

7. An apparatus according to claim 1, wherein said slots are rectangular.

8. An apparatus for the continuous kinematic high frequency treatment of a substance comprising:

a first holder;

at least one rotatable comminuting member ring with a first and second end, said first end fitted onto said first holder;

a second holder; and at least one other comminuting member ring with a first end and a second end, said first end fitted onto said second holder, said at least one other comminuting member ring arranged cylindrically within said at least one rotatable comminuting ring to is rotatable relative to each other wherein said at least one comminuting member ring and said at least one other comminuting member ring are provided with slots between the first and second ends, said slots being closed at said second end and wherein said slots have a width of less than 1 mm.

9. An apparatus according to claim 8, wherein said first holder is shaped as a stator and said second holder is shaped as a rotor, said at least one comminuting member ring comprising an inner stator comminuting member ring and an outer stator comminuting member ring, said at least one other comminuting member ring comprises an inner rotor comminuting member ring and an outer rotor comminuting member ring and wherein said slots are disposed on the outer stator comminuting ring.

10. An apparatus according to claim 8, wherein said slots have a width of less than 0.5 mm.

11. An apparatus according to claim 8, wherein said substance is a mixture of substances.

12. An apparatus according to claim 9, wherein said inner rotor comminuting ring is provided with slots which are open at one end thereof forming teeth.

13. An apparatus according to claim 8, wherein said slots are formed by a carbon dioxide laser.

14. An apparatus according to claim 8, wherein said slots are formed by a solid state laser.

15. An apparatus according to claim 8 wherein said slots are rectangular.

* * * * *